US008858291B1

(12) United States Patent
Hahn

(10) Patent No.: US 8,858,291 B1
(45) Date of Patent: Oct. 14, 2014

(54) MOMENTUM IN PRECESSION LEVERAGE UNIT

(75) Inventor: Stacey Elyn Hahn, Barstow, CA (US)

(73) Assignee: Stacey E. Hahn, Bakersfield, CA (US)

( * ) Notice: Subject to any disclaimer, the term of this patent is extended or adjusted under 35 U.S.C. 154(b) by 465 days.

(21) Appl. No.: 13/200,014

(22) Filed: Sep. 15, 2011

(51) Int. Cl.
*A63H 1/00* (2006.01)

(52) U.S. Cl.
CPC ..... *A63H 1/00* (2013.01)
USPC ..... 446/264; 446/256; 446/85; 446/233; D21/460

(58) Field of Classification Search
CPC ..... A63H 1/00
USPC ..... D21/460–464; 446/233–235, 256–263; 74/5 R
See application file for complete search history.

(56) References Cited

U.S. PATENT DOCUMENTS

| | | | | | |
|---|---|---|---|---|---|
| 24,430 | A | * | 6/1859 | Millward | 446/262 |
| 93,760 | A | * | 8/1869 | Sparks | 446/264 |
| 188,174 | A | * | 3/1877 | Packer | 446/213 |
| 215,458 | A | * | 5/1879 | Jones | 446/256 |
| 484,960 | A | * | 10/1892 | Hardy | 446/233 |
| 541,802 | A | * | 6/1895 | Barus | 446/146 |
| 543,787 | A | * | 7/1895 | Segassie | 446/262 |
| 656,771 | A | * | 8/1900 | Koscialowski | 446/262 |
| 668,607 | A | * | 2/1901 | Wheeler | 446/146 |
| 685,311 | A | * | 10/1901 | Ward | 446/264 |
| 724,664 | A | * | 4/1903 | Cook | 446/262 |
| 1,025,299 | A | * | 5/1912 | Pearsall et al. | 446/260 |
| 1,038,299 | A | * | 9/1912 | Coppins | 446/262 |
| 1,109,562 | A | * | 9/1914 | Wingert | 446/262 |
| 1,262,061 | A | * | 4/1918 | Kristofek | 446/256 |
| 1,267,558 | A | * | 5/1918 | Komorous | 446/256 |
| 1,609,336 | A | * | 12/1926 | Ward | 446/262 |
| 1,872,203 | A | * | 8/1932 | Wily | 446/262 |
| 2,075,729 | A | * | 3/1937 | Kee | 446/258 |
| 2,282,314 | A | * | 5/1942 | Houlihan | 446/256 |
| D138,494 | S | * | 8/1944 | Hacmac | D21/460 |
| 3,370,377 | A | * | 2/1968 | Frangos | 446/233 |
| 3,672,095 | A | * | 6/1972 | Goldfarb et al. | 446/263 |
| 3,936,974 | A | * | 2/1976 | House | 446/250 |
| 4,202,133 | A | * | 5/1980 | Sahar | 446/255 |
| 4,233,774 | A | * | 11/1980 | Sahar | 446/36 |
| 4,453,342 | A | * | 6/1984 | Sahar | 446/37 |
| D301,259 | S | * | 5/1989 | Rubino | D21/460 |
| D397,376 | S | * | 8/1998 | Hwang | D21/460 |
| 6,612,895 | B2 | * | 9/2003 | Sze | 446/233 |
| 2007/0021029 | A1 | * | 1/2007 | Weidetz et al. | 446/256 |

FOREIGN PATENT DOCUMENTS

| | | | | |
|---|---|---|---|---|
| JP | 2000312780 | * | 1/2000 | A63H 1/04 |
| JP | 2000197776 | * | 7/2000 | A63H 1/04 |
| JP | 2004154473 | * | 6/2004 | A63H 1/04 |

* cited by examiner

*Primary Examiner* — Gene Kim
*Assistant Examiner* — Matthew B Stanczak

(57) ABSTRACT

The "MOMENTUM IN PRECESSION LEVERAGE UNIT" assumes certain characteristics of a "spinner", yet contains elements that involve momentum beyond simple rotation. This leverage unit is manually effected, and will distribute energy into a profound visual, as well as real, compelled correction (direction) of flux. The dimensional constraint of this leverage unit element will also allow for a "pulsation" effect due to a precession of energy fields created through the Exacted Degree Center Cone Body, and accompanying "confluence" of components comprising the leverage unit. In purpose, this leverage unit shall indicate whether a surface forum plane is level, and shall as well identify any forum shift or irregularity.

9 Claims, 4 Drawing Sheets

MOMENTUM IN PRECESSION LEVERAGE UNIT

CROSS-REFERENCE

Not Applicable

FEDERAL SPONSOR/RESEARCH

Not Applicable

INCORPORATION BY REFERENCE/COMPACT DISK

Not Applicable

BACKGROUND OF INVENTION

No este cautus, the "spinner", or toy top, has been focal in culture throughout known history. What had been obscured would be what is postulate of it's purpose, beyond theory "En-Momentum". Envisioned through a creation by this inventor antecedent, a revised secondary use of an included elemental consort would now exact about the following: The "why" of Socratic formula had yet to remand its secrets under the "how/what" compendium.

Herein, this inventor seeks to begin closure of this sojourn, to bring a different type of understanding under the simple construction of childs play. To introduce the idea that, through questioning, mathematics may adjunct into one of the many purpose of toys . . . ergo, a spark of interest into the invest of evolution.

SUMMARY OF INVENTION

The scope of this inventors' vision rests upon the premise of "impending" momentum. To state simply, the unit described, infra, will attempt increase in its torque upon manual initiation of movement, and will continue to compel a "semi-permanent" energy correction, or stability, of flux without initiate prodding through gear or electrical/magnetic interference by other device.

A method of optimal efficiency allows the leverage unit to improve function, as about in the quality of 'happy hour', wherein the effect produced is something akin to a "consistent pulsation", as opposed to "vibration", that is visible to the user, and can be maintained for an accountable period of time (at sets of (2>n>1 pulsation(s) per second) within (n>10-30 seconds momentum)).

DEFINITIONS (1). Non-Uniform Longitudinal Axis:

By omission of the 'static' gravitational intensity of conventional axis, this concept of axis shall compel a direct flux correction through the continual expanding/contracting of axis vertical and cylindrical dimensions.

(2). Vector Mass:

A constant mass of space between two(2) or more solid elements, determined through angle to inclined mass ratio of said solid elements. A mass/area of aggregate as opposed to flux.

(3). Exacted Degree:

A specific and unique angle (degree) promoted from one or more point of plane (180°>(n) not equal to 90°) to 0.001° of certainty.

BRIEF DESCRIPTION OF SEVERAL VIEWS OF DRAWINGS

Figure 1:
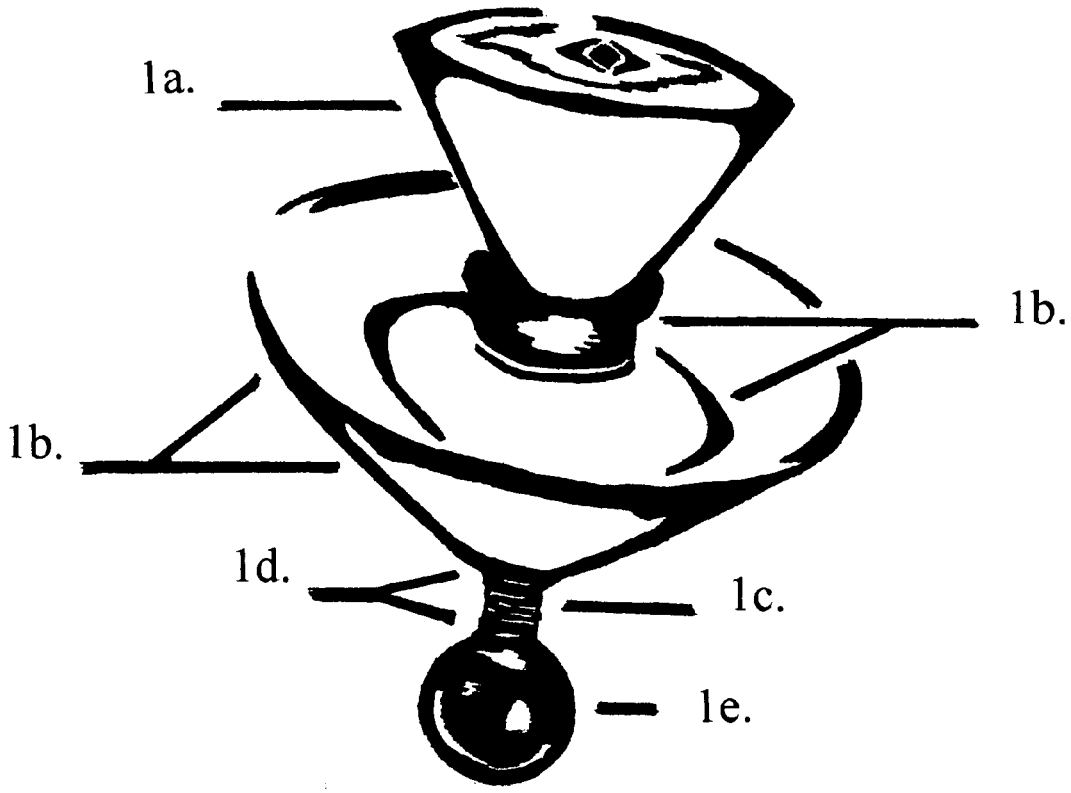

FIG. 1. ⅞ Perspective Front View

Figure 2:
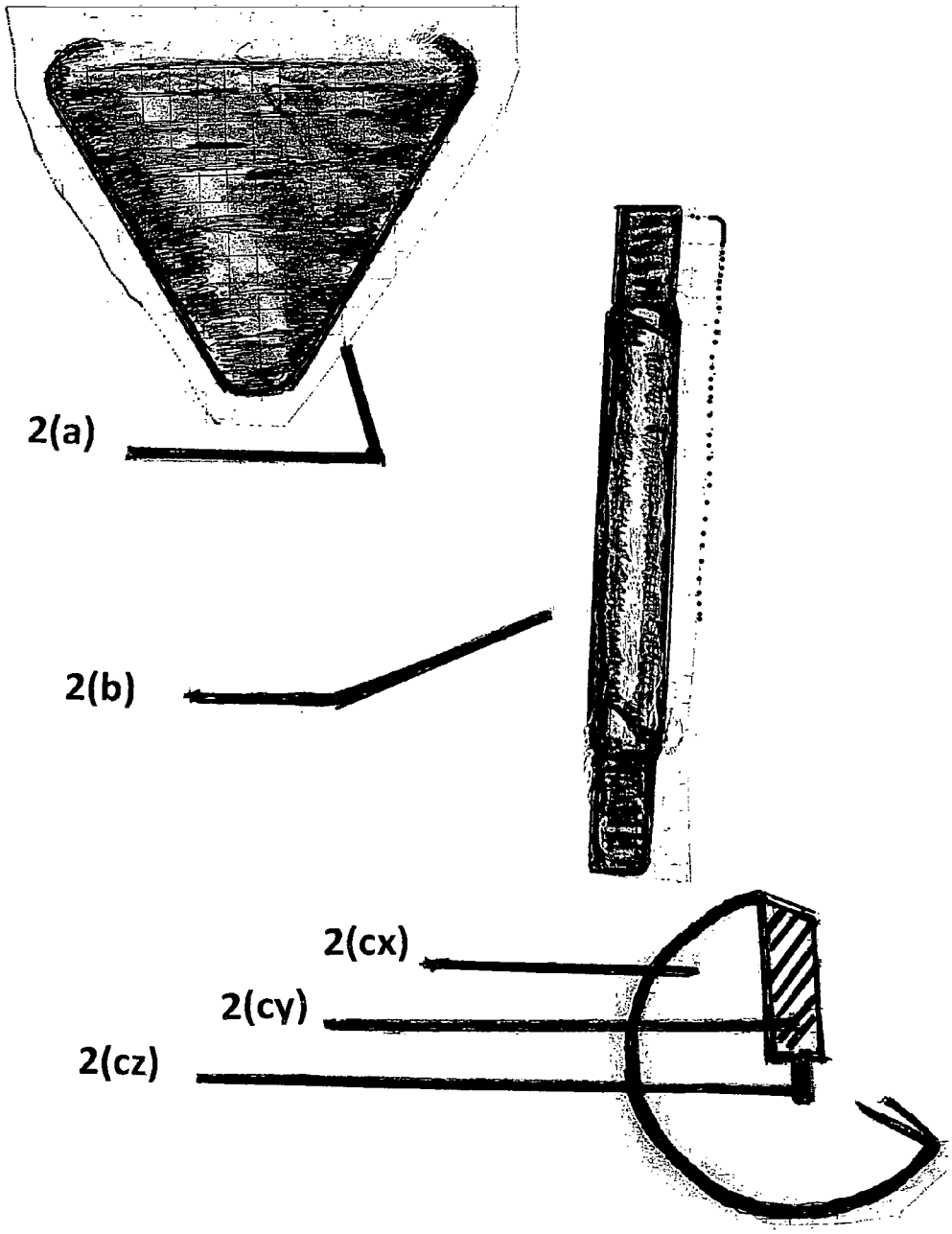

FIG. 2. Full Perspective View

Figure 3:
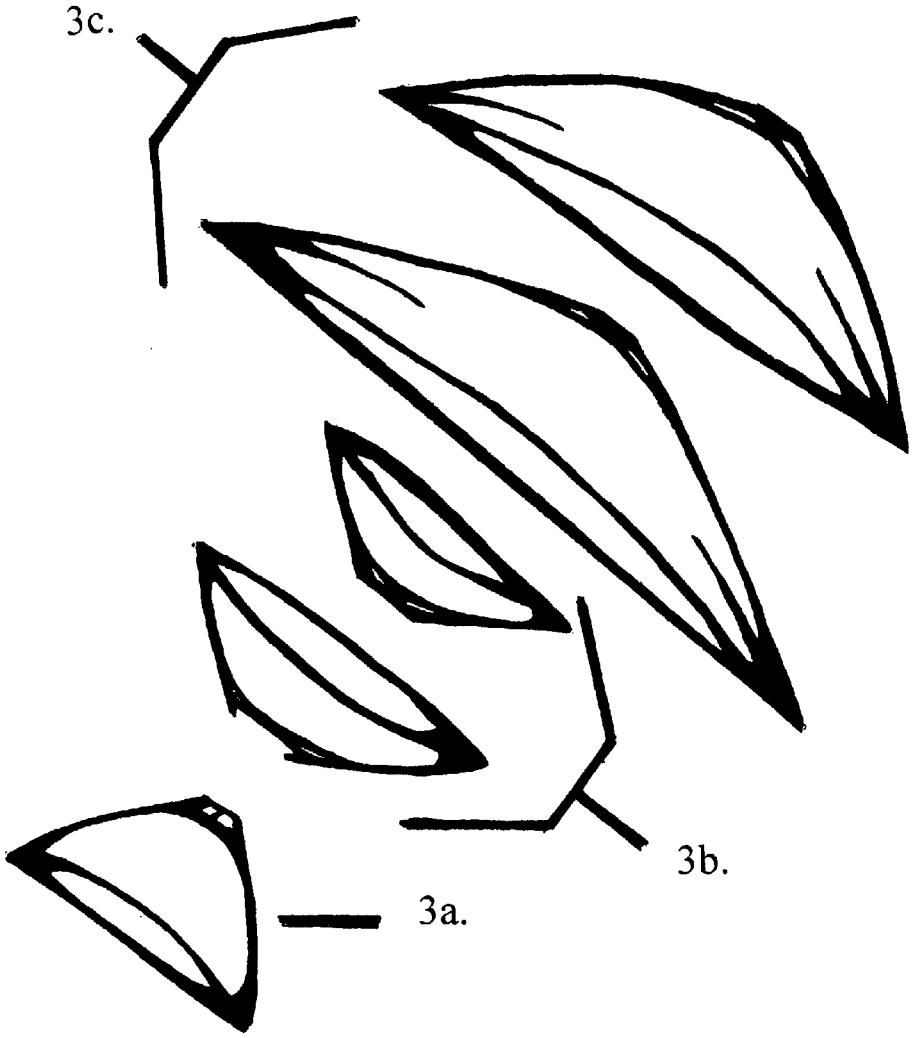

FIG. 3. ½ Exploded View

Figure 4:
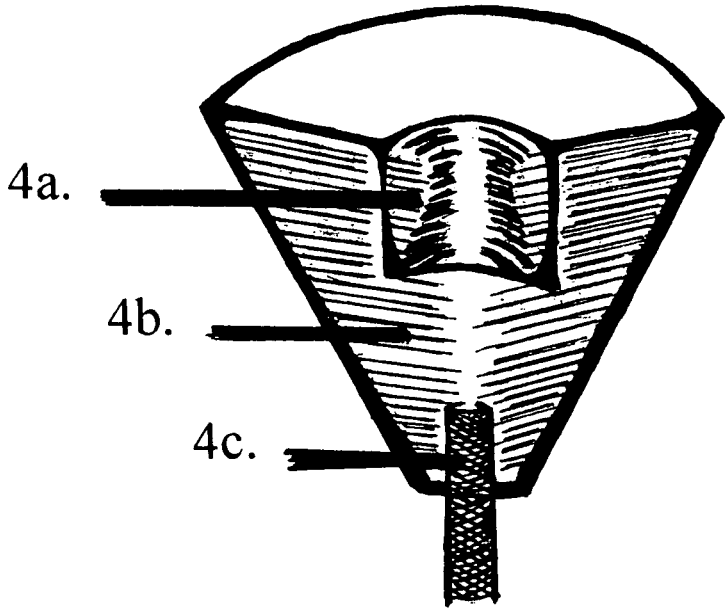

FIG. 4. Full Cross-Section View

FIG. 1. The ⅞ Perspective Front View variegates the optimal focal point of the unit. The components of description are as follows:

(1*a*). EXACTED DEGREE CENTER CONE BODY: Primary element of leverage unit as critical to provoke momentum and direct flux correction of unit;

(1*b*). SECURED LEVERAGE DISK ASSEMBLY: to provide stability and balance external/internal atmosphere re-uptake of unit;

(1*c*). AXLE BODY AS SHAFT-PIN: to provide longitudinal confluent connection between Exacted Degree Center Cone body (internal connection of top of axle body as the area of highest density within cone body), through the leverage disk assembly, to the 360° ball bearing surface forum connecting element;

(1*d*). SPRING SLEEVE to counter any inconsistent formation that would interfere with unit confluence (1*e*). A SINGLE 360° BALL BEARING TO PROVIDE A WEIGHTED SPIN BASE OF SUBSTANTIAL MASS; to assure completion of energy field and flux-stability, in connection to surface forum through a spring sleeve upon axle body shaft of unit to ball bearing.

FIG. 2. The Full Perspective and Induct View sever about the cone (2*a*), the axle body and thread terminate ends (2*b*), and ball bearing material constant (2*cx*), ball bearing master thread section (2*cy*), ball bearing sub-section to apportion proper sub-stantial mass (2*cz*).

FIG. 3. The ½ Exploded View involves the differentiation of leverage disks as applied to Front View 1*b:*

(3*a*) Disk 3*a*(1*b*), or Angle of Convex, specific to provide nominal external air flow upon activation of unit, and levy assemblage;

(3*b*). Disk 3*b*(1*b*) is a double disk assemblage, given to center point descending angles specific as a stability element to house Disk 3*a*, as well as contain focus upon extranuate axle body dimensions to provide area for liberation of chaos;

(3*c*). Disk 3*c*(1*b*) is a double disk assemblage, given to center point descending angles specific to provide a directive of rotation to enable continuation of confluence of external air flow upon activation of unit.

FIG. 4. Full Cross-Section of Exacted Degree Center Cone Embodiment involving the areas pertaining to Non-Uniform Longitudinal Axis:

(4*a*). 4*a*(1*a*) Exacted Degree Center Cone body Distal Area of specific cylindrical depth/circumference for aggregate of vector mass constant into concentration of internal Cone medium gravity, lowest density;

(4*b*). 4*b*(1*a*) Exacted Degree Center Cone body Proximal Area for concentration of internal Cone highest gravity, medium density;

(4*c*). 4*c*(1*a*(1*c*)) Confluent Exacted Degree Center Cone Body axle engagement for hub and concentration of internal Cone lowest gravity, highest density.

DETAILED DESCRIPTION OF INVENTION

This leverage unit does retain certain embodiments, shared element(s) commonplace with many rotation units, including: a mounted body; a place of singular connection between the unit and a separate surface forum and/or plane; movement pending necessitation of a physical launch by the hand and fingers of the user, and; a single degree of rotation.

What does extend beyond certain embodiments of rotation of most units (including gyroscopic toys and tops), as exclusive and unique to the leverage unit herein, are as follows:

(1). Physical launch is enabled directly upon exterior Exacted Degree Center Cone body;

(2). A pulsation within the energy field of the leverage unit;

(3). An internal, non-uniform, longitudinal axis;

(4). A confluence of internal structure, whereby all elements function without areas of indifference (separation).

To clarify, the leverage unit directs (corrects) a more complex field of inert energy compendium, or flux, into a simple influence (energy field) of non-competitive motion. In concert, the energy field is distributed (re-directed) with ease back into the unit of function, completing momentum. This is accomplished through the following:

(1). As a flux momentum will not occur independent of inertia; a multi-plane circulation of non-competitive energy will occur under limitations due law of geometrical restraint, ergo; the leverage unit component dimensions allow an energy compendium existence maintained through a balance of mass vs. plane divisions;

(2). Inclusion of general trigonometry premise to accord variation of certain foreseeable limitations, such as area of chaos, thus enabling a causal continuum to invite maximum endurance within energy fields;

(3). Sequential promotion of energy re-uptake subject upon a single non-uniform longitudinal axis contained within the principle of vector mass energy constant, while committing to avoidance of static conforms that tend to plague momentum, ergo; thus avoiding a concentric unity of components about a uniform axis so to allow for an inert energy compendium, rather than create a centrifuge.

Adaptation of components are of significant importance when in consideration of tending construction. The leverage unit envisioned maintains an unburdened embodiment of mechanical components limited to:

(1). Aluminum lathed Exacted Degree Center Cone body; bottom of cone drilled to mount confluent to shaft pin (axle body), and top drilled to specific cylindrical depth and diameter to account vector mass: non-concentric effector of dimensions critical to function of mass and energy compendium throughout unit;

(2). Steel/Aluminum leverage stamp press disk assembly, included upon angles of convex, drilled to thread upon shaft pin (axle body) and abut securely (but not invasively) to exterior base of Exacted Degree Center Cone body to: prevent external air mass disturbance to interior of unit; ensure stability of external atmosphere upon unit, as well as; liberate area of chaos.

(3). Steel uniform axle body (shaft pin), threaded to connect confluent to internal base of Exacted Degree Center Cone body and a single 360° ball bearing: creates exquisite focal definition of concentricity along axle body shaft; assimilated axle body material completes 360° ball bearing mass/weight upon master by axle body end; a spring sleeve at connection of axle body end to ball bearing shall ensure proper securing of leverage disk assembly confluence of unit;

(4). Single steel ball bearing, drilled to house confluent to shaft pin (axle body) end: substantial in weight, critical in providing dimension of equal mass ratio among/within entire unit.

The utility element of the leverage unit are designed to allow for maximum precession of energy to influence angles of trajectory, and shall be shown to minimize the static conduit commonplace with many designs of similar activation.

As devised, the specified components of the leverage unit shall also allow for manipulation of a surface forum, that shall enable the leverage unit to traverse the surface forum according to the specifics of forum variance, thus indication level vs. shift in any particular plane. Submit, infra, to enforce the utility element of the leverage unit, a comparison of existent unit features vs. those pertaining to similar units, including tops (spinners) and toy gyros, is as follows:

1 Absence of 30°, 45° and accrued 90° and/or according complementary angles throughout the entire unit, so to: (a) omit the need for "aggregate" stabilizers (a problem found in gyroscopic stabilizers, as well as certain miscellaneous units including toy tops (spinners); (b) omit concentricity of entire unit, and; (c) omit various static conforms.

2. The Exacted Degree Center Cone body is a non-concentric prioritized element for dimension of momentum energy, as opposed to being dependant upon other criteria to determine function (as found within devices prospect upon motorized activators), The modulation of momentum depends upon the following dimensions of the cone component: (a) wherein gradient of gravitation shall utilize area of highest density/lowest gravity to employ least resistance to flux momentum; (b) wherein gradient of gravitation shall utilize area of medium density/highest gravity to employ direction and release to flux momentum, and; (c) wherein gradient of gravitation shall utilize area of lowest density, medium gravity to employ highest resistance to flux momentum, to allow for mitigation of external vs. internal force influence, thus completing the beginning creation of a non-competitive energy field.

3. Inclusion of a single external approximated 90° hub at exterior of Exacted Degree Center Cone body base exterior to shaft pin (axle body) to stabilize area for induction/secure of leverage disks. Upon Angle of Convex, disks are inclusive, varying in degree and mass, to: (a) avoid interference with interior/exterior base of Exacted Degree Center Cone body; (b) mitigate marginal differences in pressure and mass created through function of rotation; (c) allow for area of liberation of chaos (where non-concentric vs. concentric fields meet), and; (d) void arbitrary shapes not critical to function of leverage unit (as found upon gyroscopic toys, tops (spinners), and other miscellaneous systems)

4. Absence of orthongonal angles throughout cone component interior of leverage unit, so to: (a) avoid hindrance of employment of motion/activity; (b) avoid the necessity of a high rate of initial force to activate and; (c) avoid limitations of a 'sphere' constriction (as founded upon gyroscopic toys of yesteryear), and; (d) avoid creation of a centrifuge as opposed to allowing a flux momentum (as found among certain torque converters).

5. Extranuate Axle Body is three fold in function, providing: (a) area of highest density, lowest gravity in center cone element; (b) priority in mastering 360° ball bearing into a stabilized element, and; (c) between (a) and (b), critical in providing a defining concentric focal element to maintain uniform leverage of disk assembly 6. Single 360° ball bearing is of a substantial mass, and function is pivotal as: (a) a weighted base for equating entire unit element mass-area ratio; (b) committing to intensity/duration of unit rotation through minimizing 'necessity' of high percentage of unit base area strata (as found in most tapered base of toy tops, gyros, and like structure), and; (c) contrast (and as opposed to) a minimal contributor of mass/momentum influence (as listed upon many toys/devices that contain 'ball shaped' or other type 'precession' connectors).

7 Angle of Convex reduces the external interference upon unit to: (a) ensure internal dimensions in cone function are not impeded; (b) ensure upkeep of momentum circulation shall retain intensive in gravitational concert, (c) ensure area for liberation of chaos is confluent, and; (d) ensure all leverage disk components are in unison.

The components of the toy top unit as envisioned have been compared within elements of units of similar insanity. SEE CLAIM.

What this inventor claims is:

1. A toy top leverage unit for rotation comprising:

(a) a truncated upper aluminum exacted degree center cone body of uniformly distributed and consistent material having a top surface, an inward tapering side surface with an angle of ascension of the side surface within 0.001 of certainty from a central vertical axis running top to bottom, and a bottom surface, the body further comprising a hollowed cylinder portion starting at the top surface and having a depth less than the bottom surface and a diameter less than that of the top of the center cone body, the bottom surface further comprising a threaded hole staring at the bottom surface and having a depth less than the hollowed cylinder portion and a diameter less than that of the bottom of the center cone body;

(b) an upper middle steel or aluminum leverage disk element assembly having at least one disk having a top surface, an tapering side surface with an upwardly convex angle, and a bottom surface, wherein the upper middle leverage disk element assembly's convex angle degree extends proportionate to the upper aluminum exacted degree center cone body's angle of ascension, and wherein a hub of the angle of a convex point of origin and an angle of center cone body point of origin are compelled to adjunct vector mass upon and within a first two upper middle lever disk assembly point of origin, and further comprising a through hole from the top to bottom surface, (c) a lower middle circular spring sleeve having a through portion;

(d) a lower uniform steel ball bearing, wherein the circular ball bearing further comprises a threaded hole starting at a top surface and having a depth less than that of a bottom surface and further having an inner master in the modified ball bearing element-to-axle threaded terminal end section; wherein a sub-section beyond this master thread section shall apportion unimpeded, having a depth less than that of the bottom surface;

(e) a uniform steel common post axle body element threaded at both terminal ends and configured to span the upper middle leverage disk element assembly through hole and the lower middle circular spring sleeve through portion, the top end configured to be threadably engagable with upper exacted degree center cone, the lower end configured to be threabably engagable with the lower steel ball so that when the unit is assembled for operational rotation, the spring sleeve securely abuts both the bottom surface of the upper middle leverage disk element assembly and the top of surface of the lower ball bearing;

and wherein entire weight of the toy top leverage unit is 45 grams.

2. The toy top leverage unit of claim 1 wherein the upper leverage disk element assembly comprises at least four disks.

3. The toy top leverage unit of claim 2, wherein the at least four disks further comprise two middle upper and two middle lower disks, the two upper middle disks are assembled non-inverse, connecting the two upper middle disks points of origins with and upon the angle of convex disk point of origin at the hub of the angle of ascension of the truncated cone closing in upon the hub along the vertical axis; wherein the two middle lower disks are assembled inverse, to interface with the two middle upper disks, as the two middle lower disks points of origin are removed further from the hub among the vertical axis.

4. The toy top leverage unit of claim 1 wherein the upper aluminum exacted degree center cone body of uniformly distributed and consistent material further comprises three regions: an upper hollowed region being medium gravity and lowest density, a mid-region being highest gravity and medium density, and a lower threaded region being lowest gravity and highest density.

5. The toy top leverage unit of claim 1 wherein the angle of ascension of upper center cone body is 31.875 degrees with regards to the vertical axis.

6. The toy top leverage unit of claim 1 wherein the upper degree center cone and the upper leverage disk element assembly securedly abut each other when toy top leverage unit is assembled.

7. The toy top leverage unit of claim 1 wherein the upper leverage disk element assembly is interchangeable with leverage disk elements of various angles and mass in order to avoid interference with the upper exacted degree center cone body, mitigate marginal differences in pressure and mass created through rotation, allow for area of liberation of chaos, and avoid arbitrary shapes not critical to the function.

8. The toy top leverage unit of claim 1 wherein the unit is void of 30°, 45° and 90° angles except for an approximate 90° connection between the lower portion of the upper exacted degree center cone body and the common post axle body element.

9. The toy top leverage unit of claim 1 wherein uniform steel common post axle body element is of the highest density in the leverage unit.

* * * * *